US011506419B2

(12) United States Patent
Suehiro et al.

(10) Patent No.: US 11,506,419 B2
(45) Date of Patent: Nov. 22, 2022

(54) INDOOR UNIT OF AIR-CONDITIONING APPARATUS AND AIR-CONDITIONING APPARATUS

(71) Applicant: Mitsubishi Electric Corporation, Tokyo (JP)

(72) Inventors: Hironobu Suehiro, Tokyo (JP); Tatsuo Furuta, Tokyo (JP); Naoya Matsunaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 185 days.

(21) Appl. No.: 16/639,787

(22) PCT Filed: Oct. 26, 2017

(86) PCT No.: PCT/JP2017/038768
§ 371 (c)(1),
(2) Date: Feb. 18, 2020

(87) PCT Pub. No.: WO2019/082349
PCT Pub. Date: May 2, 2019

(65) Prior Publication Data

US 2020/0248927 A1 Aug. 6, 2020

(51) Int. Cl.
*F24F 13/20* (2006.01)
*F24F 11/89* (2018.01)
*F24F 11/52* (2018.01)

(52) U.S. Cl.
CPC ..... *F24F 13/20* (2013.01); *F24F 11/52* (2018.01); *F24F 11/89* (2018.01)

(58) Field of Classification Search
CPC ..... F24F 13/20; F24F 2013/207; F24F 11/89; F24F 11/52; F16B 2200/205
See application file for complete search history.

(56) References Cited

U.S. PATENT DOCUMENTS

2007/0066215 A1* 3/2007 Song ..... F24F 1/0071 62/317
2011/0229258 A1 9/2011 Hirota

FOREIGN PATENT DOCUMENTS

CN 102342190 A 2/2012
EP 2 458 293 A2 5/2012
(Continued)

OTHER PUBLICATIONS

International Search Report of the International Searching Authority dated Dec. 19, 2017 in corresponding International Patent Application No. PCT/JP2017/038768 (and English translation).
(Continued)

*Primary Examiner* — Schyler S Sanks
(74) *Attorney, Agent, or Firm* — Posz Law Group, PLC

(57) ABSTRACT

An indoor unit of an air-conditioning apparatus includes a shell in which a light-receiving window is formed; a display unit attached to an inner surface of the shell; and a cover attached to the display unit, the cover covering the light-receiving window. The cover includes a first end portion, a second end portion located opposite to the first end portion, one of a first engagement portion and a first engagement-receiving portion provided at the first end portion, the first engagement-receiving portion being engaged with the first engagement portion, and one of a first lug portion and a first lug-receiving portion provided at the second end portion, the first lug-receiving portion being engaged with the first lug portion. The display unit includes the other of the first engagement portion and the first engagement-receiving portion, and the other of the first lug portion and the first lug-receiving portion.

10 Claims, 9 Drawing Sheets

(56) References Cited

FOREIGN PATENT DOCUMENTS

| | | | | |
|---|---|---|---|---|
| EP | 2458293 | A2 * | 5/2012 | ..... F24F 13/20 |
| JP | H10-132328 | A | 5/1998 | |
| JP | 2003-322355 | A | 11/2003 | |
| JP | 2012-149816 | A | 8/2012 | |
| KR | 10-2001-0095685 | A | 11/2001 | |

OTHER PUBLICATIONS

Chinese Office Action dated Dec. 2, 2020, issued in corresponding CN Patent Application No. 201780096140.5 (and English Machine Translation).
Extended European Search Report dated Sep. 10, 2020 issued in corresponding EP application No. 17929665.2.
Chinese Office Action dated Jul. 2, 2021, issued in corresponding CN Patent Application No. 201780096140.5 (and English Machine Translation).
Office Action dated Jan. 4, 2022 issued in corresponding CN patent application No. 201780096140.5 (and English translation).
Office Action dated Apr. 19, 2022 issued in corresponding CN Patent Application No. 201780096140.5 (and English translation).
Office Action dated Jul. 20, 2022 issued in corresponding CN patent application No. 201780096140.5 (and English translation).
Office Action dated Sep. 15, 2022 issued in corresponding European Patent Application No. 17929665.2.

* cited by examiner

INDOOR UNIT OF AIR-CONDITIONING APPARATUS AND AIR-CONDITIONING APPARATUS

This application is a U.S. national stage application of PCT/JP2017/038768 filed on Oct. 26, 2017, the contents of which are incorporated herein by reference.

TECHNICAL FIELD

The present disclosure relates to an indoor unit of an air-conditioning apparatus having a shell in which a light-receiving window is formed, the light-receiving window allowing infrared signals output from a remote controller to pass through the light-receiving window, and an air-conditioning apparatus including the indoor unit.

BACKGROUND ART

Some indoor unit of an air-conditioning apparatus that has been proposed is configured in such a manner that an opening is provided in a shell and that the opening is covered with a cover attached to a display unit (see, for example, Patent Literature 1). The indoor unit of an air-conditioning apparatus described in Patent Literature 1 includes a display unit having a display plate attached to the front of the display unit and having LED elements. A design layer on which letters, numbers, or other symbols are printed is provided to the display plate. The shell of the indoor unit of an air-conditioning apparatus described in Patent Literature 1 has an opening provided in a front surface of the shell. The display unit having the display plate attached to the front of the display unit is attached to an inner surface of the shell. When the display unit is attached to the inner surface of the shell, the opening in the shell is covered with the display plate attached to the front of the display unit. Thus, the indoor unit of an air-conditioning apparatus described in Patent Literature 1 is configured in such a manner that when the letters, numbers, or other symbols on the design layer are illuminated by the LED elements, light emitted from the LED elements passes through the letters, numbers, or other symbols so that the letters, numbers, or other symbols light up. The letters, numbers, or other symbols that have lit up are visible through the opening in the shell.

In the indoor unit of an air-conditioning apparatus described in Patent Literature 1 having the above-described structure, the display plate is attached to the display unit in the manner specifically described below. A display panel included in a front part of the display unit has a light-transmitting window formed in the display panel. The light-transmitting window is a quadrangular opening through which light from the LED elements passes. In addition, a U-shaped projection engaged with an edge portion of the light-transmitting window is formed on a back surface of the display plate. A plurality of lug portions are also formed on the back surface of the display plate. The display panel has a plurality of projections engaged with the lug portions on the display plate at positions corresponding to the positions of the lug portions. Thus, the display plate is attached to the display panel by engaging the U-shaped projection on the display plate with the edge portion of the light-transmitting window in the display panel and engaging the lug portions on the display plate with the projections on the display panel.

CITATION LIST

Patent Literature

Patent Literature 1: Japanese Unexamined Patent Application Publication No. 2012-149816

SUMMARY OF INVENTION

Technical Problem

As described above, the display plate included in the indoor unit of an air-conditioning apparatus described in Patent Literature 1 has the U-shaped projection and the lug portions, which are used to attach the display plate to the display panel, on the back surface of the display plate. In other words, the display plate included in the indoor unit of an air-conditioning apparatus described in Patent Literature 1 is shaped to have a flange portion at the outer periphery around the U-shaped projection and the lug portions when the display plate is viewed from the back of the display plate. In the indoor unit of an air-conditioning apparatus described in Patent Literature 1, the flange portion therefore visually blocks the U-shaped projection on the display plate and the edge portion of the light-transmitting window in the display panel, and it is difficult to engage the U-shaped projection with the edge portion of the light-transmitting window in the display panel. Similarly, in the indoor unit of an air-conditioning apparatus described in Patent Literature 1, the flange portion visually blocks the lug portions on the display plate and the projections on the display panel, and it is difficult to engage the lug portions with the projections. Thus, the indoor unit of an air-conditioning apparatus described in Patent Literature 1 has a problem in that the display plate cannot be easily attached to the display panel.

The present disclosure has been made to solve the above-described problem, and a first object of the present disclosure is to provide an indoor unit of an air-conditioning apparatus in which an opening is provided in a shell, the opening being covered with a cover attached to a display unit, and in which the cover can be more easily attached to the display unit than in some indoor unit. A second object of the present disclosure is to provide an air-conditioning apparatus including the indoor unit.

Solution to Problem

An indoor unit of an air-conditioning apparatus according to one embodiment of the present disclosure includes a shell in which a light-receiving window is formed; a display unit attached to an inner surface of the shell; and a cover attached to the display unit, the cover covering the light-receiving window. The cover includes a first end portion, a second end portion located opposite to the first end portion, one of a first engagement portion and a first engagement-receiving portion provided at the first end portion, the first engagement-receiving portion being engaged with the first engagement portion, and one of a first lug portion and a first lug-receiving portion provided at the second end portion, the first lug-receiving portion being engaged with the first lug portion. The display unit includes the other of the first engagement portion and the first engagement-receiving portion, and the other of the first lug portion and the first lug-receiving portion.

An air-conditioning apparatus according to another embodiment of the present disclosure includes the indoor unit of an air-conditioning apparatus according to an embodiment of the present disclosure and an outdoor unit.

Advantageous Effects of Invention

According to the indoor unit of an air-conditioning apparatus of an embodiment of the present disclosure, the first engagement portion and the first engagement-receiving portion are visible when the first engagement portion is being engaged with the first engagement-receiving portion. In addition, in the indoor unit of an air-conditioning apparatus of an embodiment of the present disclosure, the first lug portion and the first lug-receiving portion are visible when the first lug portion is being engaged with the first lug-receiving portion. In the indoor unit of an air-conditioning apparatus of an embodiment of the present disclosure, the cover can be therefore more easily attached to the display unit than in some indoor unit.

DESCRIPTION OF EMBODIMENTS

Embodiment 1

An example of an indoor unit of an air-conditioning apparatus according to the present disclosure will be described below with reference to the drawings. In each of the drawings referred to below, structures denoted by the same reference signs are the same or corresponding structures. Structures described in Embodiment 1 are merely examples. The indoor unit of an air-conditioning apparatus according to the present disclosure is not limited to the structures described in Embodiment 1. In each of the drawings referred to below, the relationships between the sizes of the components may differ from the actual relationships.

Figure 1:
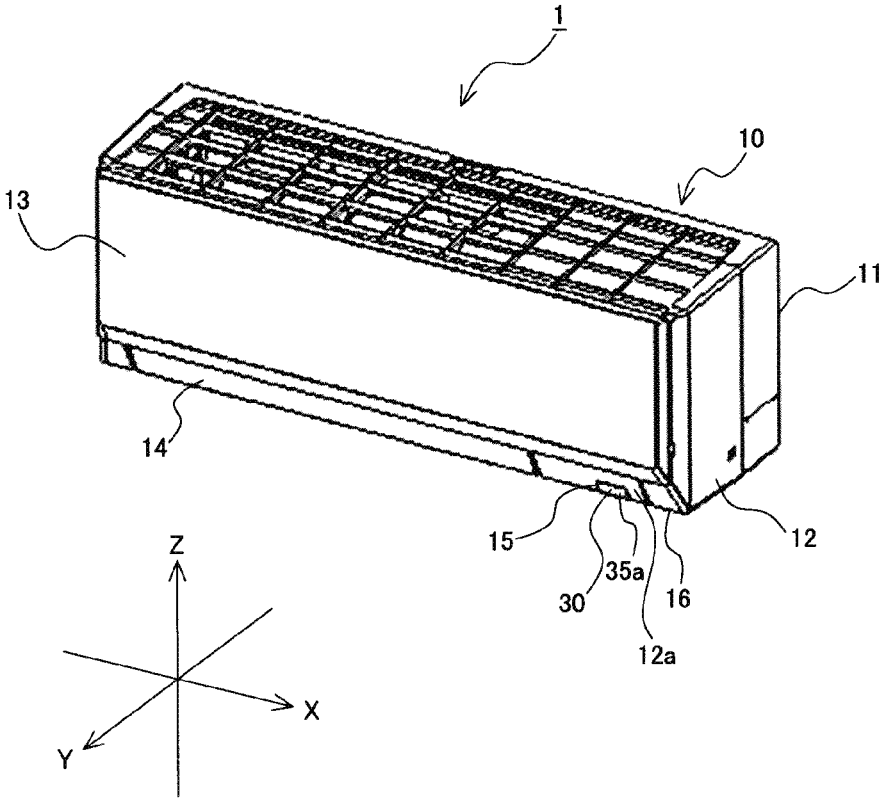
FIG. 1 is a front perspective view of an indoor unit of an air-conditioning apparatus according to Embodiment 1 of the present disclosure.
Figure 2:
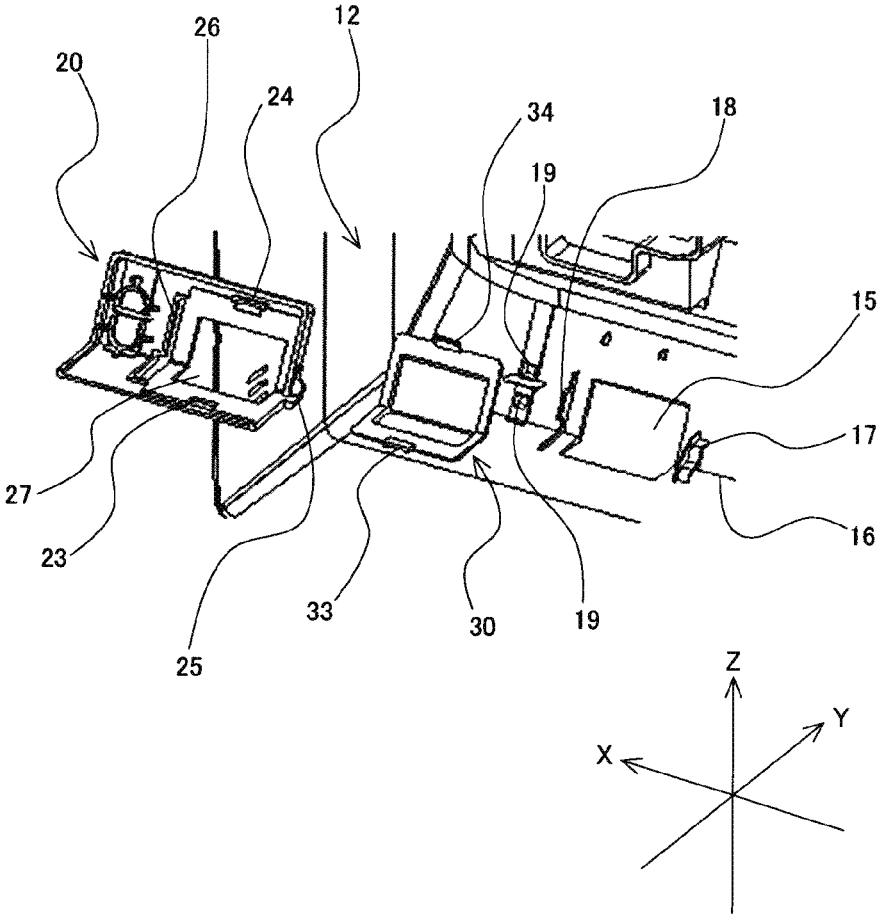
FIG. 2 is an exploded perspective view, viewed from the inside of the indoor unit, of components around a light-receiving window in the indoor unit of an air-conditioning apparatus according to Embodiment 1 of the present disclosure.

FIG. 1 is a front perspective view of an indoor unit of an air-conditioning apparatus according to Embodiment 1 of the present disclosure. FIG. 1 illustrates an indoor unit 1 according to Embodiment 1 viewed obliquely from above, the indoor unit 1 being disposed in an air-conditioned space. FIG. 2 is an exploded perspective view, viewed from the inside of the indoor unit, of components around a light-receiving window in the indoor unit of an air-conditioning apparatus according to Embodiment 1 of the present disclosure. To facilitate understanding of the viewing directions of FIGS. 1 and 2 and other drawings referred to below, the X-axis, Y-axis, and Z-axis are defined as follows. As illustrated in FIG. 1, the vertical direction of the indoor unit 1 is defined as the Z-axis. More specifically, the upward direction is defined as the plus-Z-axis direction. In addition, as illustrated in FIG. 1, the horizontal direction in front view of the indoor unit 1 is defined as the X-axis. More specifically, the left-to-right direction in front view of the indoor unit 1 is defined as the plus X-axis direction. In addition, as illustrated in FIG. 1, the front-back direction of the indoor unit 1 is defined as the Y-axis. More specifically, the back-to-front direction of the indoor unit 1 is defined as the plus Y-axis direction.

The indoor unit 1 includes a substantially cuboid shell 10. The shell 10 has a light-receiving window 15 formed in the shell 10. The light-receiving window 15 is, for example, a substantially quadrangular opening through which infrared signals output from a remote controller pass. In Embodiment 1, the light-receiving window 15 is formed in a corner portion 16 that connects a front surface and a bottom surface of the shell 10. Specifically, a portion of the light-receiving window 15 opens in the front surface of the shell 10, and the remaining portion of the light-receiving window 15 opens in the bottom surface of the shell 10. The light-receiving window 15 may be formed at any position. For example, the light-receiving window 15 may instead be formed only in the front surface of the shell 10.

The shell 10 of the indoor unit 1 according to Embodiment 1 includes a box 11, a panel unit 12, a front panel 13, and a vane 14. The box 11 defines a rear surface of the shell 10. The panel unit 12 defines a portion of the front surface of the shell 10 and top, bottom, left, and right surfaces of the shell 10. The light-receiving window 15 is formed in the panel unit 12. The front panel 13 defines a portion of the front surface of the shell 10. The vane 14 covers an air inlet when the indoor unit 1 is not in operation. The vane 14 is capable of swinging vertically. When the indoor unit 1 is in operation, the vane 14 moves to uncover the air inlet and adjusts the vertical direction in which air is blown out of the air inlet. The above-described structures of the shell 10 are merely examples.

Figure 3:
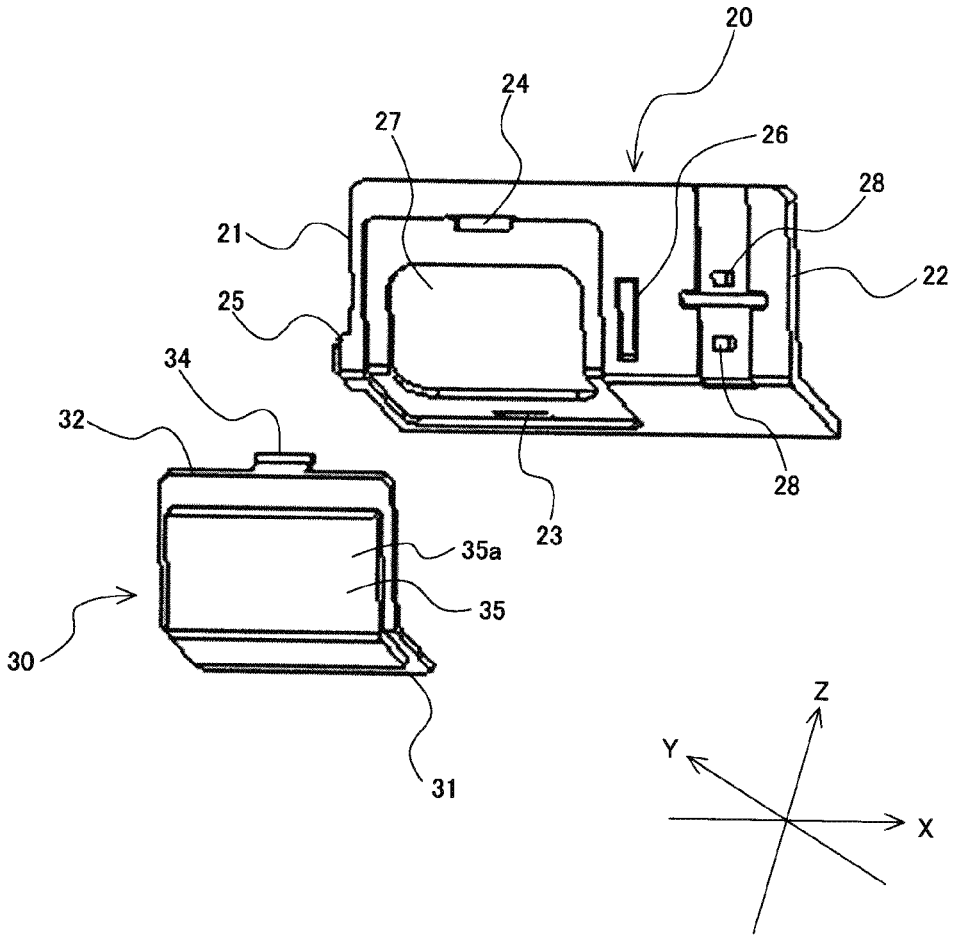
FIG. 3 is an exploded perspective view of a display unit and a cover according to Embodiment 1 of the present disclosure.

The light-receiving window 15 formed in the panel unit 12 is covered with a cover 30. The cover 30 is made from a material capable of transmitting infrared signals output from the remote controller. More specifically, the cover 30 is attached to the panel unit 12 and covers the light-receiving window 15 in the manner described below. The indoor unit 1 includes a display unit 20. As illustrated in FIG. 3 described below, the display unit 20 has projections 28 that transmit light from LED elements that turn on or off depending on the operational state of the indoor unit 1. The cover 30 is attached to the display unit 20. The display unit 20 is attached to the inner surface of the panel unit 12 in such a manner that the cover 30 covers the light-receiving window 15.

When the display unit 20 is attached to the panel unit 12, an outer peripheral portion of the cover 30 is disposed between the display unit 20 and an inner peripheral surface of the panel unit 12. The display unit 20 has, for example, a substantially quadrangular opening 27 that is located to face the light-receiving window 15 in such a manner that infrared signals output from the remote controller can pass through the display unit 20. When the display unit 20 is attached to the panel unit 12, the projections 28 on the display unit 20 are positioned to face through holes 19 in the panel unit 12. Consequently, the on-off states of the LED elements are visually recognizable from the outside of the indoor unit 1.

The manner in which the cover 30 and the display unit 20 are attached together will be described below in detail.

Figure 4:
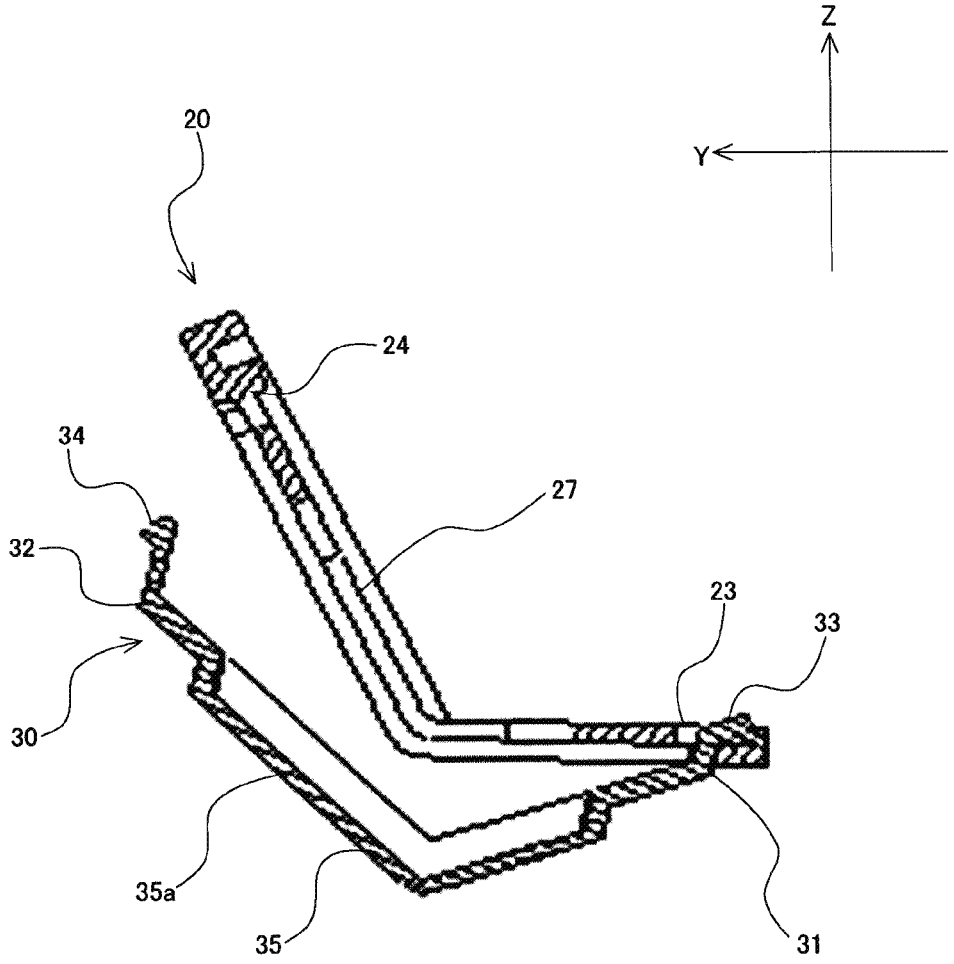
FIG. 4 is a sectional view of the display unit and the cover according to Embodiment 1 of the present disclosure.

FIG. 3 is an exploded perspective view of the display unit and the cover according to Embodiment 1 of the present disclosure. FIG. 4 is a sectional view of the display unit and the cover according to Embodiment 1 of the present disclosure. FIG. 3 illustrates the display unit 20 and the cover 30 viewed in the minus Y-axis direction before the cover 30 is attached to the display unit 20. FIG. 4 shows cross sections of the display unit 20 and the cover 30 taken along a plane parallel to the Y-axis and the Z-axis and viewed in the minus X-axis direction when the cover 30 is being attached to the display unit 20.

The cover 30 is, for example, a substantially quadrangular plate-shaped part. As described above, the light-receiving window 15 is formed in the corner portion 16 of the panel unit 12. Consequently, the cover 30, which covers the light-receiving window 15, is substantially L-shaped in cross section in such a manner that the shape of the cover 30 corresponds to the shape of the corner portion 16 of the panel unit 12. The cover 30 includes an end portion 31, which is a bottom end portion, and an end portion 32 located opposite to the end portion 31. In other words, the end portion 32 is a top end portion. The end portion 31 is provided with an engagement portion 33 projecting toward an outer periphery from the end portion 31. The end portion 32 is provided with a lug portion 34 projecting toward the outer periphery from the end portion 32. The lug portion 34 has a hook portion that engages with a lug-receiving portion 24, which will be described below, at an end of the lug portion 34.

The display unit 20 is, for example, a substantially quadrangular plate-shaped part. The display unit 20 is formed to extend along the corner portion of the panel unit 12. Consequently, the display unit 20, which is a plate-shaped part, is substantially L-shaped in cross section. The display unit 20 has an engagement-receiving portion 23 that engages with the engagement portion 33 of the cover 30. In Embodiment 1, the engagement-receiving portion 23 is a through hole. The display unit 20 also has the lug-receiving portion 24 that engages with the lug portion 34 of the cover 30. In Embodiment 1, the lug-receiving portion 24 is a through hole. The cover 30 is attached to the display unit 20 by engaging the engagement portion 33 of the cover 30 with the engagement-receiving portion 23 of the display unit 20 from the front of the display unit 20 and engaging the lug portion 34 of the cover 30 with the lug-receiving portion 24 of the display unit 20 from the front of the display unit 20.

The end portion 31 of the cover 30 corresponds to a first end portion of the present disclosure. The end portion 32 of the cover 30 corresponds to a second end portion of the present disclosure. The engagement portion 33 of the cover 30 corresponds to a first engagement portion of the present disclosure. The lug portion 34 of the cover 30 corresponds to a first lug portion of the present disclosure. The engagement-receiving portion 23 of the display unit 20 corresponds to a first engagement-receiving portion of the present disclosure. The lug-receiving portion 24 of the display unit 20 corresponds to a first lug-receiving portion of the present disclosure.

The end portion 31 of the cover 30 may instead be provided with the engagement-receiving portion 23, and the display unit 20 may instead be provided with the engagement portion 33. In other words, the end portion 31 of the cover 30 is provided with one of the engagement portion 33 and the engagement-receiving portion 23. The display unit 20 is provided with the other of the engagement portion 33 and the engagement-receiving portion 23. Similarly, the end portion 32 of the cover 30 may instead be provided with the lug-receiving portion 24, and the display unit 20 may instead be provided with the lug portion 34. In other words, the end portion 32 of the cover 30 is provided with one of the lug portion 34 and the lug-receiving portion 24. The display unit 20 is provided with the other of the lug portion 34 and the lug-receiving portion 24. The cover 30 may be provided with one of the engagement portion 33 and the engagement-receiving portion 23 on an end portion other than the end portion 31. The cover 30 may be provided with one of the lug portion 34 and the lug-receiving portion 24 on an end portion opposite to the end portion other than the end portion 31. In this case, the end portion provided with one of the engagement portion 33 and the engagement-receiving portion 23 corresponds to the first end portion of the present disclosure. The end portion provided with one of the lug portion 34 and the lug-receiving portion 24 corresponds to the second end portion of the present disclosure.

As the cover 30 and the display unit 20 are structured as described above, the engagement portion 33 and the engagement-receiving portion 23 are visible when the engagement portion 33 is being engaged with the engagement-receiving portion 23. In addition, the lug portion 34 and the lug-receiving portion 24 are visible when the lug portion 34 is being engaged with the lug-receiving portion 24. Thus, when the cover 30 and the display unit 20 are structured as described above, the cover 30 can be more easily attached to the display unit 20 than when the display plate is attached to the display panel in the indoor unit according to Patent Literature 1.

The manner in which the panel unit 12 and the display unit 20 are attached together will be described below in detail.

Figure 5:
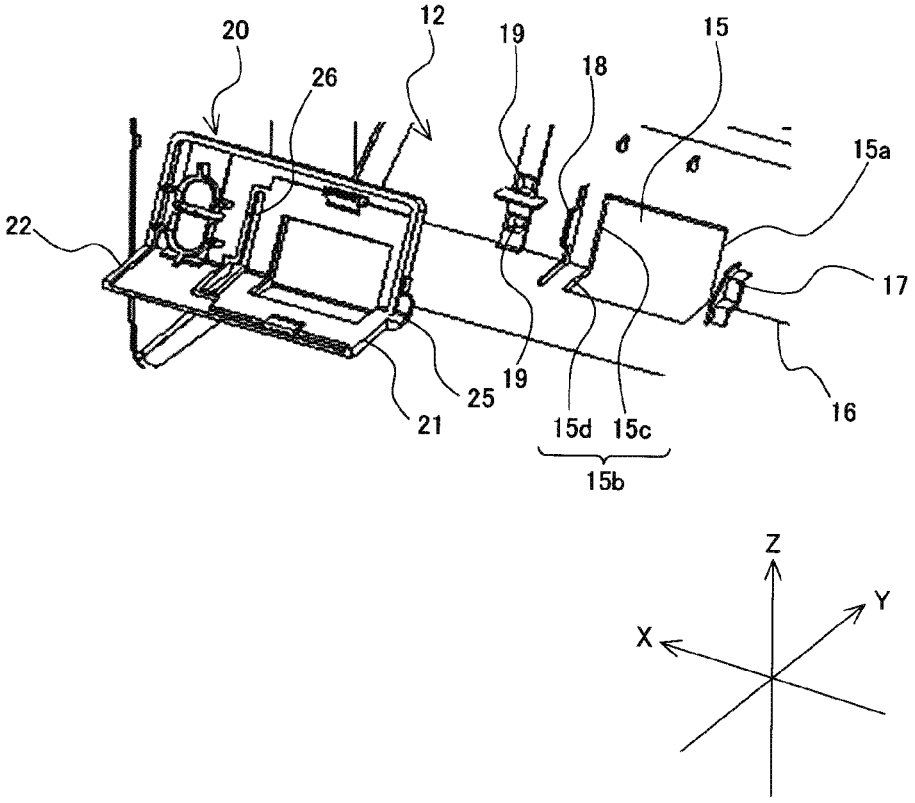
FIG. 5 is an exploded perspective view of a panel unit and the display unit according to Embodiment 1 of the present disclosure.
Figure 6:
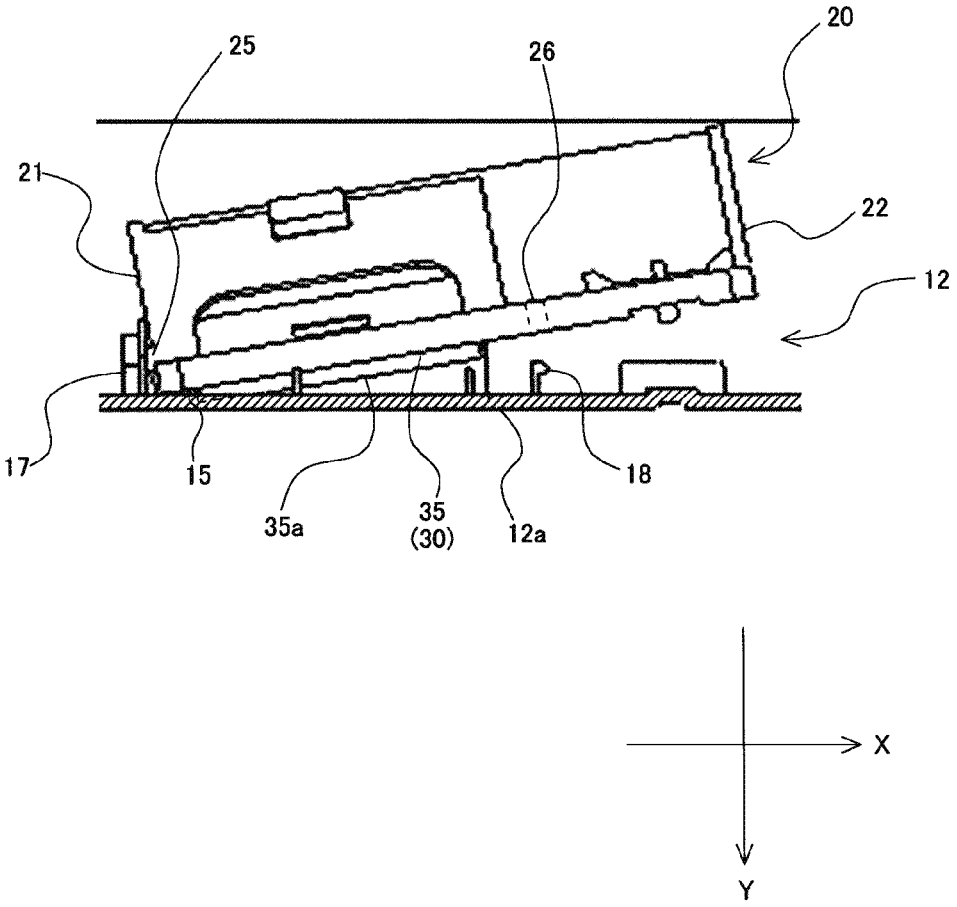
FIG. 6 is a sectional view of the panel unit and the display unit according to Embodiment 1 of the present disclosure.
Figure 7:
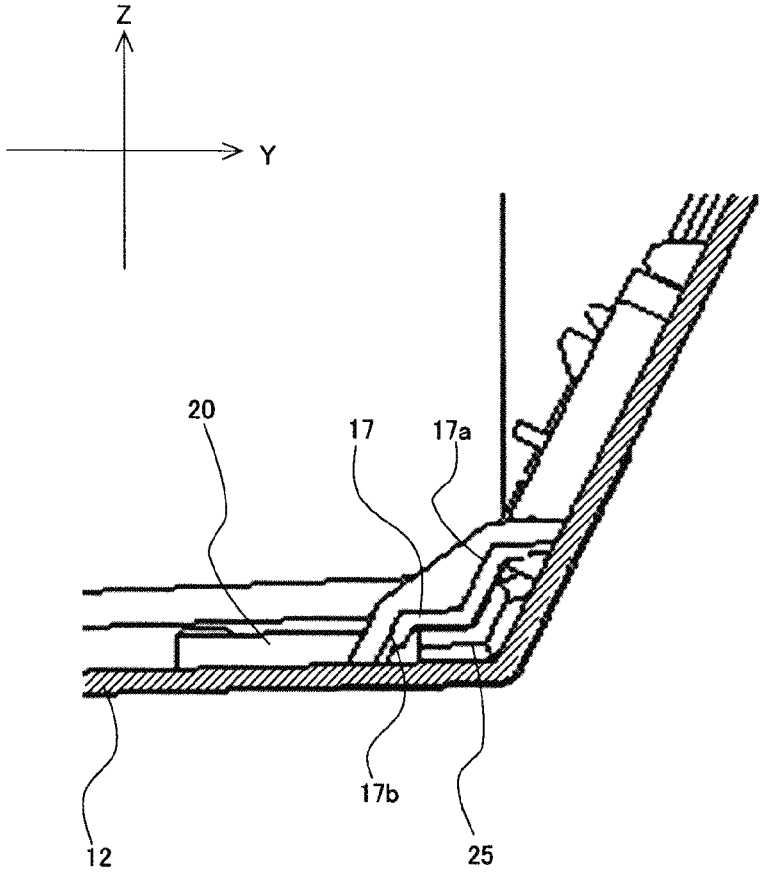
FIG. 7 is a sectional view of a region including an engagement portion of the display unit according to Embodiment 1 of the present disclosure.
Figure 8:
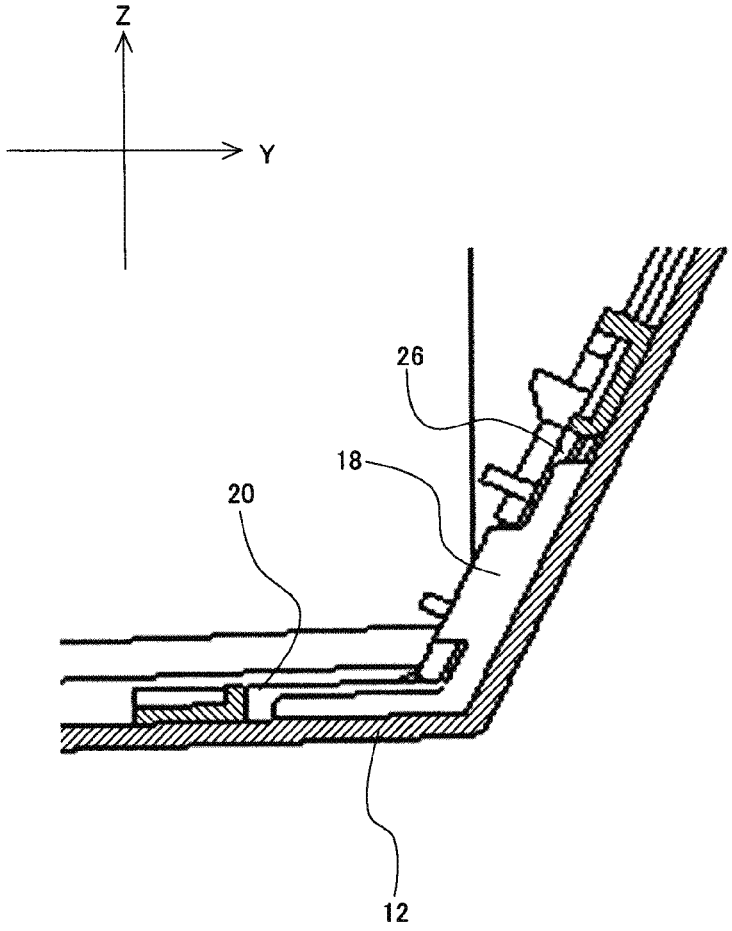
FIG. 8 is a sectional view of a region including a lug-receiving portion of the display unit according to Embodiment 1 of the present disclosure.

FIG. 5 is an exploded perspective view of the panel unit and the display unit according to Embodiment 1 of the present disclosure. FIG. 6 is a sectional view of the panel unit and the display unit according to Embodiment 1 of the present disclosure. FIG. 7 is a sectional view of a region including an engagement portion of the display unit according to Embodiment 1 of the present disclosure. FIG. 8 is a sectional view of a region including a lug-receiving portion of the display unit according to Embodiment 1 of the present disclosure. FIG. 5 illustrates the panel unit 12 and the display unit 20 viewed from the inside of the panel unit 12 in the plus-Y-axis direction before the display unit 20 is attached to the panel unit 12. FIG. 6 shows cross sections of the panel unit 12 and the display unit 20 taken along a plane parallel to the Y-axis and the X-axis and viewed in the minus-Z-axis direction when the display unit 20 is being attached to the panel unit 12. FIG. 7 illustrates a cross section of a region including an engagement portion 25 taken along a plane parallel to the Y-axis and the Z-axis and viewed in the plus X-axis direction when the display unit 20 is attached to the panel unit 12. FIG. 8 illustrates a cross section of a region including a lug-receiving portion 26 taken along a plane parallel to the Y-axis and the Z-axis and viewed in the plus-X-axis direction when the display unit 20 is attached to the panel unit 12.

The panel unit 12 is provided with an engagement-receiving portion 17 disposed beside a first side 15*a*, which is one of the sides of the light-receiving window 15. The engagement-receiving portion 17 engages with the engagement portion 25, which will be described below. In Embodiment 1, the engagement-receiving portion 17 includes a plate portion 17*a* extending parallel to the inner surface of the panel unit 12 at a position separated from the inner surface by a predetermined distance and two leg portions 17*b* connecting the plate portion 17*a* to the inner surface of the panel unit 12. The panel unit 12 is also provided with a lug portion 18 disposed beside a second side 15*b* located opposite to the first side 15*a* of the light-receiving window 15. The lug portion 18 projects from the inner surface of the panel unit 12. The lug portion 18 has a hook portion that engages with the lug-receiving portion 26, which will be described below, at an end of the lug portion 18.

The display unit 20 includes an end portion 21 and an end portion 22 located opposite to the end portion 21. The end portion 21 is provided with the engagement portion 25, which projects toward the outer periphery from the end portion 21 and engages with the engagement-receiving portion 17 of the panel unit 12. The display unit 20 includes the lug-receiving portion 26, which engages with the lug portion 18 of the panel unit 12, at a position between the end portion 21 and the end portion 22. In Embodiment 1, the lug-receiving portion 26 is a through hole. The display unit 20 is attached to the inner surface of the panel unit 12 in such a manner that the display unit 20 extends along the inner surface of the panel unit 12 by engaging the engagement portion 25 of the display unit 20 with the engagement-receiving portion 17 of the panel unit 12 and engaging the lug portion 18 of the panel unit 12 with the lug-receiving portion 26 of the display unit 20.

The end portion 21 of the display unit 20 corresponds to a third end portion of the present disclosure. The end portion 22 of the display unit 20 corresponds to a fourth end portion of the present disclosure. The engagement portion 25 of the display unit 20 corresponds to a second engagement portion of the present disclosure. The lug-receiving portion 26 of the display unit 20 corresponds to a second lug-receiving portion of the present disclosure. The engagement-receiving portion 17 of the panel unit 12 corresponds to a second engagement-receiving portion of the present disclosure. The lug portion 18 of the panel unit 12 corresponds to a second lug portion of the present disclosure.

The end portion 21 of the display unit 20 may instead be provided with the engagement-receiving portion 17, and the panel unit 12 may instead be provided with the engagement portion 25. In other words, the end portion 21 of the display unit 20 is provided with one of the engagement portion 25 and the engagement-receiving portion 17. The panel unit 12 is provided with the other of the engagement portion 25 and the engagement-receiving portion 17. Similarly, the display unit 20 may instead be provided with the lug portion 18 at a position between the end portion 21 and the end portion 22, and the panel unit 12 may instead be provided with the lug-receiving portion 26. In other words, the display unit 20 is provided with one of the lug-receiving portion 26 and the lug portion 18 at a position between the end portion 21 and the end portion 22. The panel unit 12 is provided with the other of the lug-receiving portion 26 and the lug portion 18.

The display unit 20 may be provided with one of the engagement portion 25 and the engagement-receiving portion 17 on an end portion other than the end portion 21. The display unit 20 may be provided with one of the lug-receiving portion 26 and the lug portion 18 at a position between the end portion other than the end portion 21 and an end portion opposite to the end portion other than the end portion 21. In this case, the end portion provided with one of the engagement portion 25 and the engagement-receiving portion 17 corresponds to the third end portion of the present disclosure. The end portion opposite to the end portion other than the end portion 21 corresponds to the fourth end portion of the present disclosure. In this case, the other of the engagement portion 25 and the engagement-receiving portion 17 may be provided beside one of the top and bottom sides of the light-receiving window 15 on the inner surface of the panel unit 12. The other of the lug-receiving portion 26 and the lug portion 18 may be provided beside the other of the top and bottom sides of the light-receiving window 15 on the inner surface of the panel unit 12. In this case, one of the top and bottom sides beside which the other of the engagement portion 25 and the engagement-receiving portion 17 is provided corresponds to the first side of the present disclosure. Also, one of the top and bottom sides beside which the other of the lug-receiving portion 26 and the lug portion 18 is provided corresponds to the second side of the present disclosure.

The display unit 20 is typically connected and fixed to the panel unit 12 at both end portions of the display unit 20. When the display unit 20 is instead connected and fixed to the panel unit 12 at positions described in Embodiment 1, the distance between the positions at which the display unit 20 and the panel unit 12 are connected can be reduced. Consequently, in the case where the display unit 20 is connected and fixed to the panel unit 12 at positions described in Embodiment 1, the display unit 20 is not easily bent when the cover 30 is pushed from the outside.

The cover 30 includes a projection 35 having substantially the same shape as the shape of the light-receiving window 15. The height of the projection 35 is substantially equal to the thickness of the panel unit 12. When the display unit 20 is attached to the panel unit 12, as illustrated in FIG. 6, the projection 35 of the cover 30 attached to the display unit 20 is inserted into the light-receiving window 15 in the panel unit 12. Consequently, as illustrated in FIG. 1, an outer surface 12*a* of the panel unit 12 and an outer surface 35*a* of the projection 35 are flush with each other. As the projection 35 of the cover 30 is inserted into the light-receiving window 15 in the panel unit 12, rattling of the cover 30 can be prevented. In addition, the design of the indoor unit 1 can be improved as the outer surface 12*a* of the panel unit 12 and the outer surface 35*a* of the projection 35 are flush with each other.

As described above, the cover 30 is disposed between the display unit 20 and the panel unit 12. More specifically, the cover 30 is disposed in front of the display unit 20. When the projection 35 is formed on the cover 30, attachment of the display unit 20 and the cover 30 to the panel unit 12 can be therefore facilitated. More specifically, if the cover 30 is disposed behind the display unit 20, the display unit 20 needs to have an opening for receiving the projection 35 of the cover 30. To insert the projection 35 into the light-receiving window 15 without a tilt, it is necessary to position the opening in the display unit 20 and the projection 35 of the cover 30, and then position the projection 35 and the light-receiving window 15. Thus, the process of attaching the display unit 20 and the cover 30 to the panel unit 12 is cumbersome. In contrast, when the cover 30 is disposed in front of the display unit 20, the projection 35 can be inserted into the light-receiving window 15 without a tilt simply by positioning the projection 35 and the light-receiving window 15. Thus, when the cover 30 is disposed between the display unit 20 and the panel unit 12, the display unit 20 and the cover 30 can be easily attached to the panel unit 12.

According to the indoor unit 1 of Embodiment 1, the display unit 20 is provided at the corner portion 16 of the panel unit 12. In this case, the engagement-receiving portion 17 and the engagement portion 25 are preferably structured as follows. That is, as illustrated in FIG. 7, the engagement-receiving portion 17 is preferably provided at the corner portion 16. A portion of the engagement-receiving portion 17 that receives the engagement portion 25 may be substantially L-shaped to follow the shape of the corner portion 16. The engagement portion 25 may also be substantially L-shaped. When the engagement-receiving portion 17 and the engagement portion 25 are structured as described above, the display unit 20 can be prevented from being displaced in the Y-axis direction and Z-axis direction by one engagement-receiving portion 17 and one engagement portion 25.

When the display unit 20 is provided at the corner portion 16 of the panel unit 12, the lug portion 18 is preferably disposed at a position described below. When the display unit 20 is provided at the corner portion 16 of the panel unit 12, the second side 15*b* of the light-receiving window 15 includes a side 15*c* of the front surface of the panel unit 12 and a side 15*d* of the bottom surface of the panel unit 12. In this case, the lug portion 18 is preferably disposed beside the longer one of the side 15*c* and the side 15*d*. As illustrated in FIG. 5, in Embodiment 1, the side 15*c* is longer than the side 15*d*. Consequently, in Embodiment 1, the lug portion 18 is disposed beside the side 15*c*. When the lug portion 18 is disposed at this position, the length of the lug portion 18 in the direction of the second side 15*b* can be made longer than the length of the lug portion 18 in the direction of the second side 15*b* when the lug portion 18 is disposed beside the side 15*d*. Thus, the display unit 20 can be prevented from being displaced in the Y-axis direction and the Z-axis direction by one lug portion 18. In addition, when the cover 30 is pushed from the outside, bending of the display unit 20 can be further reduced by one lug portion 18.

A procedure for covering the light-receiving window 15 with the cover 30 will be described below.

First, the cover 30 is attached to the display unit 20 by engaging the engagement portion 33 of the cover 30 with the engagement-receiving portion 23 of the display unit 20 from the front of the display unit 20 and engaging the lug portion 34 of the cover 30 with the lug-receiving portion 24 of the display unit 20 from the front of the display unit 20. Then, the display unit 20 is attached to the inner surface of the panel unit 12 by engaging the engagement portion 25 of the display unit 20 with the engagement-receiving portion 17 of the panel unit 12 and engaging the lug portion 18 of the panel unit 12 with the lug-receiving portion 26 of the display unit 20. Consequently, the light-receiving window 15 in the panel unit 12 is covered with the cover 30 attached to the display unit 20.

The cover 30 can be removed from the panel unit 12 by reversing the above-described procedure.

The indoor unit 1 of an air-conditioning apparatus according to Embodiment 1 includes the shell 10 in which the light-receiving window 15 is formed, the display unit 20 attached to the inner surface of the shell 10, and the cover 30 attached to the display unit 20, the cover 30 covering the light-receiving window 15. The cover 30 includes the end portion 31 and the end portion 32 located opposite to the end portion 31. The cover 30 includes one of the engagement portion 33 and the engagement-receiving portion 23 on the end portion 31, the engagement-receiving portion 23 being engaged with the engagement portion 33. The cover 30 includes one of the lug portion 34 and the lug-receiving portion 24 on the end portion 32, the lug-receiving portion 24 being engaged with the lug portion 34. The display unit 20 includes the other of the engagement portion 33 and the engagement-receiving portion 23 and the other of the lug portion 34 and the lug-receiving portion 24.

Thus, in the indoor unit 1 of an air-conditioning apparatus of Embodiment 1, the engagement portion 33 and the engagement-receiving portion 23 are visible when the engagement portion 33 is being engaged with the engagement-receiving portion 23. In addition, in the indoor unit 1 of an air-conditioning apparatus of Embodiment 1, the lug portion 34 and the lug-receiving portion 24 are visible when the lug portion 34 is being engaged with the lug-receiving portion 24. In the indoor unit 1 of an air-conditioning apparatus of Embodiment 1, the cover 30 can be therefore more easily attached to the display unit 20 than when the display plate is attached to the display panel in the indoor unit described in Patent Literature 1.

In addition, in the indoor unit 1 of Embodiment 1, the number of positions at which the cover 30 and the display unit 20 are connected together can be made less than the number of positions at which the display plate is attached to the display panel in the indoor unit described in Patent Literature 1. Also in this regard, in the indoor unit 1 of an air-conditioning apparatus of Embodiment 1, the cover 30 can be more easily attached to the display unit 20 than when the display plate is attached to the display panel in the indoor unit described in Patent Literature 1.

In addition, when the cover 30 is structured as in the indoor unit 1 of Embodiment 1, unlike the display plate described in Patent Literature 1, it is not necessary to provide a structure for connecting the cover 30 to the display unit 20 on the back surface of the cover 30. When the cover 30 is structured as in the indoor unit 1 of Embodiment 1, a mold used to manufacture the cover 30 is therefore less complex than a mold used to manufacture the display plate described in Patent Literature 1.

The cover 30 and the display unit 20 may be made from different materials. In this case, the cover 30 and the display unit 20 may be each manufactured by using an appropriate material for the corresponding requirements. For example, the cover 30 may be made from a material that easily transmits infrared signals output from the remote controller. Alternatively, for example, the cover 30 may be made from a shock-resistant material. When the cover 30 is made from a shock-resistant material, in the case where the display unit 20 includes a charging unit, the cover 30 may also be used to cover the charging unit to comply with the Electrical Appliances and Materials Safety Act.

Embodiment 2

An example of an air-conditioning apparatus including the indoor unit 1 of Embodiment 1 will be described in Embodiment 2. In Embodiment 2, items that are not particularly described are the same as those in Embodiment 1, and functions and structures that are the same as those in Embodiment 1 are denoted by the same reference signs.

Figure 9:
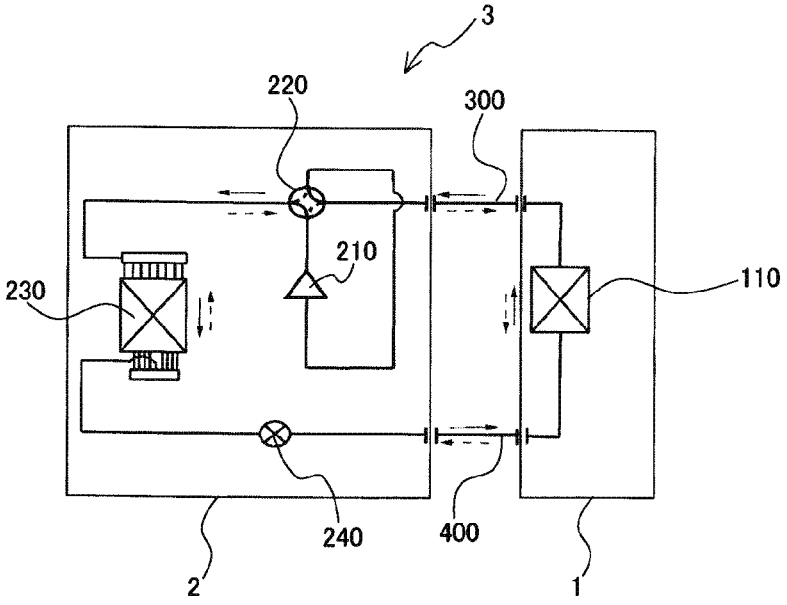
FIG. 9 is a refrigerant circuit diagram illustrating an example of an air-conditioning apparatus according to Embodiment 2 of the present disclosure.

FIG. 9 is a refrigerant circuit diagram illustrating an example of an air-conditioning apparatus according to Embodiment 2 of the present disclosure. The solid line arrows in FIG. 9 show the flow of refrigerant in a cooling operation. The broken line arrows in FIG. 9 show the flow of refrigerant in a heating operation.

An air-conditioning apparatus 3 according to Embodiment 2 includes the indoor unit 1 according to Embodiment 1 and an outdoor unit 2. The indoor unit 1 and the outdoor unit 2 are connected by pipes including a gas refrigerant pipe 300 and a liquid refrigerant pipe 400. The indoor unit 1 includes an indoor heat exchanger 110. The outdoor unit 2 includes a compressor 210, a four-way valve 220, an outdoor heat exchanger 230, and an expansion valve 240.

The compressor 210 compresses the refrigerant that has been suctioned in the compressor 210 and discharges the compressed refrigerant. Although the configuration of the compressor 210 is not particularly limited, the compressor 210 may, for example, be configured in such a manner that the capacity of the compressor 210 can be varied by freely varying an operation frequency by using, for example, an inverter circuit. The capacity of the compressor 210 is an amount of refrigerant discharged from the compressor 210 per unit time. The four-way valve 220 is, for example, a valve that switches the flows of the refrigerant depending on whether the operation is the cooling operation or the heating operation.

The outdoor heat exchanger 230 exchanges heat between the refrigerant and outdoor air. In the heating operation, the outdoor heat exchanger 230 is used as an evaporator to evaporate the refrigerant into gas. In the cooling operation, the outdoor heat exchanger 230 is used as a condenser to condense the refrigerant into liquid.

The expansion valve 240, which is an expansion device, for example, reduces the pressure of the refrigerant to expand the refrigerant. When the expansion valve 240 is, for example, an electronic expansion valve, the expansion valve 240 adjusts the opening degree in accordance with an instruction from, for example, an unillustrated controller. The indoor heat exchanger 110 exchanges heat between air in the air-conditioned space and the refrigerant. In the heating operation, the indoor heat exchanger 110 is used as a condenser to condense the refrigerant into liquid. In the cooling operation, the indoor heat exchanger 110 is used as an evaporator to evaporate the refrigerant into gas.

When the air-conditioning apparatus 3 is structured as described above, the heating operation or the cooling operation can be performed by switching the flows of the refrigerant by using the four-way valve 220 of the outdoor unit 2.

REFERENCE SIGNS LIST

1 indoor unit 2 outdoor unit 3 air-conditioning apparatus 10 shell 11 box 12 panel unit 12*a* outer surface 13 front panel 14 vane 15 light-receiving window 15*a* first side 15*b* second side 15*c* side 15*d* side 16 corner portion 17 engagement-receiving portion 17*a* plate portion 17*b* leg portion 18 lug portion 19 through hole 20 display unit 21 end portion 22 end portion 23 engagement-receiving portion 24 lug-receiving portion 25 engagement portion 26 lug-receiving portion 27 opening 28 projection 30 cover 31 end portion 32 end portion 33 engagement portion 34 lug portion projection 35*a* outer surface 110 indoor heat exchanger 210 compressor 220 four-way valve 230 outdoor heat exchanger 240 expansion valve 300 gas refrigerant pipe 400 liquid refrigerant pipe

The invention claimed is:

1. An indoor unit of an air-conditioning apparatus, comprising:

a shell in which a light-receiving window is formed;

a display unit attached to an inner surface of the shell; and a cover attached to the display unit, the cover covering the light-receiving window, wherein the cover includes:

a first end portion, a second end portion located opposite to the first end portion, one of a first engagement portion and a first engagement-receiving portion provided at the first end portion, and one of a first lug portion and a first lug-receiving portion provided at the second end portion, wherein the display unit includes:

the other of the first engagement portion and the first engagement-receiving portion not included in the cover, and the other of the first lug portion and the first lug-receiving portion not included in the cover, wherein the first engagement-receiving portion is configured to engage the first engagement portion in a first engagement direction, and wherein the first lug-receiving portion is configured to engage the first lug portion in a second engagement direction that is non-parallel to the first engagement direction.

2. The indoor unit of an air-conditioning apparatus of claim 1, wherein the shell includes one of a second engagement portion and a second engagement-receiving portion provided beside a first side of the light-receiving window, the second engagement-receiving portion being engaged with the second engagement portion, and one of a second lug portion and a second lug-receiving portion provided beside a second side located opposite to the first side of the light-receiving window, the second lug-receiving portion being engaged with the second lug portion, and wherein the display unit includes a third end portion, a fourth end portion located opposite to the third end portion, an other of the second engagement portion and the second engagement-receiving portion provided at the third end portion, and an other of the second lug portion and the second lug-receiving portion provided at a position between the third end portion and the fourth end portion.

3. The indoor unit of an air-conditioning apparatus of claim 2, wherein one of the second engagement portion and the second engagement-receiving portion provided in the shell is provided at a corner portion of the shell, and wherein the second engagement portion and a portion of the second engagement-receiving portion that receives the second engagement portion are each L-shaped along the corner portion of the shell.

4. The indoor unit of an air-conditioning apparatus of claim 1, wherein the display unit and the cover are made from different materials.

5. The indoor unit of an air-conditioning apparatus of claim 1, wherein the cover includes a projection inserted in the light-receiving window.

6. The indoor unit of an air-conditioning apparatus of claim 5, wherein an outer surface of the projection and an outer surface of the shell are flush with each other.

7. The indoor unit of an air-conditioning apparatus of claim 5, wherein the cover is disposed between the shell and the display unit.

8. An air-conditioning apparatus comprising:

the indoor unit of an air-conditioning apparatus of claim 1; and an outdoor unit.

9. The indoor unit for an air-conditioning apparatus of claim 1, wherein the first engagement direction is divergent from the second engagement direction in a direction from the cover to the display unit.

10. The indoor unit for an air-conditioning apparatus of claim 1, wherein the first engagement portion projects in a direction non-parallel to a projection direction of the first lug portion.

* * * * *